US009192223B2

(12) United States Patent
Loveday

(10) Patent No.: US 9,192,223 B2
(45) **Date of Patent: *Nov. 24, 2015**

(54) SYSTEM AND METHOD FOR A HYDRATION GARMENT

(71) Applicant: Douglas Elliot Loveday, Tucson, AZ (US)

(72) Inventor: Douglas Elliot Loveday, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/680,976

(22) Filed: Apr. 7, 2015

(65) Prior Publication Data

US 2015/0282598 A1 Oct. 8, 2015

Related U.S. Application Data

(63) Continuation-in-part of application No. 13/774,671, filed on Feb. 22, 2013, now Pat. No. 9,009,864.

(51) Int. Cl.
*A45F 3/16* (2006.01)
*A45F 5/02* (2006.01)

(52) U.S. Cl.
CPC ... *A45F 3/16* (2013.01); *A45F 5/02* (2013.01); *A45F 2003/166* (2013.01)

(58) Field of Classification Search
CPC ..... A41D 13/0015; A41D 13/0012; A41D 13/02; A41D 1/06; A41D 1/08; A41D 27/20; A45F 5/00
USPC ..... 2/69, 94, 79, 102, 227, 238, 247, 250; 224/148.4
See application file for complete search history.

(56) References Cited

U.S. PATENT DOCUMENTS

| | | | | |
|---|---|---|---|---|
| 4,564,957 | A | 1/1986 | Scharf | |
| 5,730,339 | A | 3/1998 | Stolfo | |
| 5,890,809 | A | 4/1999 | Nelson | |
| 5,909,802 | A | 6/1999 | Puco et al. | |
| 5,941,434 | A | 8/1999 | Green | |
| 5,960,471 | A | 10/1999 | Burton | |
| 6,000,664 | A | 12/1999 | Hood | |
| 6,004,033 | A | 12/1999 | Cirone | |
| 6,182,872 | B1 | 2/2001 | Six | |
| 6,626,733 | B1 | 9/2003 | Knutson | |
| 6,662,985 | B2 | 12/2003 | Harada et al. | |
| 6,859,943 | B1 | 3/2005 | Wallace, III | |
| 7,000,255 | B1 | 2/2006 | Baacke | |
| 7,058,987 | B2 | 6/2006 | Salazar | |
| 7,201,299 | B2 | 4/2007 | Forsman | |
| 7,845,506 | B2 | 12/2010 | Willows et al. | |
| 8,316,469 | B2 | 11/2012 | Miller | |
| 9,009,864 | B1 * | 4/2015 | Loveday | 2/69 |
| 2005/0109803 | A1 | 5/2005 | Shin | |
| 2007/0083984 | A1 | 4/2007 | Wagenknecht et al. | |
| 2007/0163029 | A1 | 7/2007 | Burgess et al. | |
| 2008/0216212 | A1 | 9/2008 | Burgess et al. | |

* cited by examiner

*Primary Examiner* — Tejash Patel
(74) *Attorney, Agent, or Firm* — Lisa Foundation Patent Law Clinic, Arizona State University

(57) ABSTRACT

This invention is a hydration support garment including a pair of athletic pants or shorts. The hydration support garment is comprised of a cylindrical receptacle sewn onto the rear of the aforementioned athletic apparel that is configured to house a water bottle. In some applications of the invention, the receptacle includes a receptacle strap and a perpendicular stabilizing strap. Some implementations further include an elastic strap that secures the top of the water bottle. Finally, the invention may also contain a second water bottle holder including a clip and another elastic strap or Velcro™ patches. The invention is designed to provide hands-free access to a hydration source in such a way to allow the user of the invention to exercise without manually carrying a water bottle when hydration is unnecessary.

20 Claims, 4 Drawing Sheets

SYSTEM AND METHOD FOR A HYDRATION GARMENT

CROSS REFERENCE TO RELATED APPLICATIONS

This application is a continuation-in-part of U.S. application Ser. No. 13/774,671, filed on Feb. 22, 2013 to Douglas E. Loveday, entitled "System and Method for a Hydration Garment."

BACKGROUND OF THE INVENTION

1. Field of the Invention

This present invention generally relates to garments having the ability to carry water or other beverages.

Plastic water bottles are generally disposable and are widely used during both indoor and outdoor exercising activities.

Previous inventions provide a mechanism for attaching a water bottle to an exerciser in order to facilitate hands-free athletic activity. These devices alleviate the inconvenience associated with exercising while manually carrying a bottle. However, the devices often used a belt, loop, or strap to connect the bottle to the exerciser in a loose or dangling manner. When attached in such ways, water bottles often swing a great deal during athletic activities, making exercising difficult. Further, prior water bottle carriers connect to the exerciser via a belt or carrying mechanism that is often clipped to the exerciser's waistband. These devices may inadvertently and unintentionally become unattached from the user's belt with ease.

2. Description of Related Art

The prior art generally falls into two categories. The first category includes attachable water bottle carriers. The second category includes carrying devices that are not configured for holding water bottles, but are permanently affixed to an article of clothing.

The first category includes inventions that hold bottles via loops, hooks, and other bottle gripping devices. Some inventions utilize an attachment to a waistband or pocket of a pair of pants (or shortened pants) that secures a bottle by the neck through a loop or cord around the bottle. This invention is not permanently affixed to the pants. Additionally, it is typically located on either side of the wearer, over the hip, and near one of the wearer's side pocket. Other inventions are specifically for hands-free water bottle carrying. These patents utilize a device that clips onto a user's waistband or belt and provides a form-fit grip for grasping water bottles that surround approximately three-fourths of the bottle. These inventions are meant for use on the user's side or hip and also contain a stabilizing grip that surrounds the top of the water bottle. Sometimes the bottle can be attached to the user's side or hip by a keychain; this allows the bottle to dangle. Velcro™ could also be used to stick a holder to the side of a piece of exercise equipment. The water bottle is then placed in the holder that is stuck to the equipment.

The other category includes clothing with permanent item holders. Some inventions include sewn in internal front pockets for storing firearms, ammunition, handcuffs, or police batons. The invention is typically designed for use by law enforcement officials. Belt loops can also be used that surround the user's waist to stabilize two sewn on, optionally permanent, tool carriers that are attached to a pair of pants and located halfway between the wearer's hip and knee. These inventions are typically for carpentry tools.

So as to reduce the complexity and length of the Detailed Specification, and to fully establish the state of the art in certain areas of technology, Applicant herein expressly incorporates by reference all of the following materials identified in each numbered paragraph below.

U.S. Patent Publication 2007/0083984 describes a bottle carrier attached to the pocket, belt, or waistband of a pair of pants that attaches near the cap of a bottle.

U.S. Patent Publication 2005/0109803 describes a bottle carrier that attaches to a waistband or belt via a keychain and holds a bottle just below the bottle's cap.

U.S. Pat. No. 6,004,033 describes a water receptacle that can be attached to a piece of exercise equipment through the use of Velcro.

U.S. Pat. No. 7,058,987 describes a pocket sewn into the front of a pair of trousers that can carry weapons or other equipment. It is designed for use by law enforcement officers.

U.S. Patent Publication 2008/0216212 describes carpenter pants.

Applicants believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

BRIEF SUMMARY OF THE INVENTION

The present invention provides among other things a system for a hydration support garment. The hydration support garment can include a lower body garment with a rear exterior surface and a receptacle coupled to the rear exterior surface and configured to house a first beverage container. The receptacle comprises a first strap and a receptacle strap perpendicularly intersecting one another. The hydration support garment can also include a securing strap coupled to the rear exterior surface, proximal to an open end of the receptacle, and configured to stabilize the first beverage container against the lower body garment when the first beverage container is housed within the receptacle. The hydration support garment can further include a clip coupled to the lower body garment and configured to clip to a second beverage container, and a second strap coupled to the rear exterior surface and configured to stabilize the second beverage container against the lower body garment when the second beverage container is clipped onto the clip.

In another embodiment, the hydration support garment may also be comprised of a lower body garment with a rear exterior surface, a receptacle coupled to the rear exterior surface and configured to house a first beverage container, where the receptacle comprises a first strap and a receptacle strap perpendicularly intersecting one another, and a securing strap coupled to the rear exterior surface proximal to an open end of the receptacle and configured to stabilize the first beverage container against the lower body garment when the first beverage container is housed within the receptacle. The hydration support garment may also include a clip coupled to the lower body garment and configured to clip to a second beverage container, and a Velcro patch coupled to the rear exterior surface and configured to receive a mating Velcro patch on the second beverage container to stabilize the second beverage container against the lower body garment when the second beverage container is clipped onto the clip.

In another embodiment, the hydration support garment may be comprised of a lower body garment with a rear exterior surface, a receptacle coupled to the rear exterior surface at an anchor point and configured to house a beverage container, where the receptacle comprises a first strap and a receptacle strap perpendicularly intersecting one another, and a securing strap coupled to the rear exterior surface proximal to an open end of the receptacle and configured to stabilize the beverage container against the lower body garment when the beverage container is housed within the receptacle. The hydration support garment can also include a compression strap coupled to the rear exterior surface at the anchor point and configured to wrap around one of a wearer's lower torso and a wearer's thigh to stabilize the beverage container against the wearer when the beverage container is housed within the receptacle.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Detailed Description or Description of the Drawings or claims is not intended to somehow indicate a desire to invoke the special provisions of 35 U.S.C. §112,¶6, to define the invention. To the contrary, if the provisions of 35 U.S.C. §112,¶6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112,¶6. Moreover, even if the provisions of 35 U.S.C. §112,¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

Figure 1:
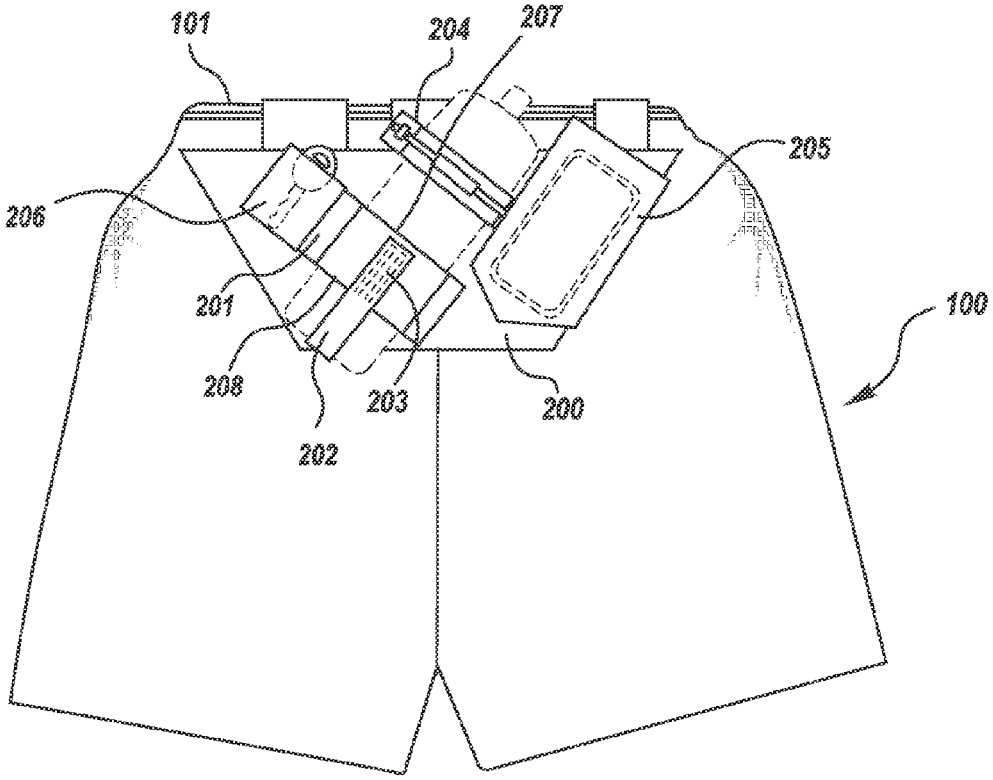
FIG. 1 illustrates a rear view of a hydration garment, according to one embodiment of the invention, including an angled beverage container receptacle.

FIG. 1 shows one embodiment of the invention. In it, a neoprene patch 200 may be sewn onto the back of a pair of commercially available or other athletic shorts 100. Pants or skirts can also be used in lieu of athletic shorts 100. The patch 200 may contain a substantially cylindrical receptacle 201 that may be sewn on the rear of the athletic pants, shorts, a skirt or other garment such that the substantially cylindrical receptacle may extend away from the user's body. The patch 200 may be located on the posterior of the athletic shorts 100 or other garment. The substantially cylindrical receptacle 201 may be comprised of a first open end 207 and a second open end 208. The substantially cylindrical receptacle 201 may also include a stabilizing strap 202 that is coupled to one exterior side of the substantially cylindrical receptacle 201, runs across second open end 208 of the receptacle, and attaches to the opposite exterior side of the second open end 208 of the substantially cylindrical receptacle. The mechanism of attachment may include a hook and loop fastener, such as Velcro™ or a clipping device 203 or another similar mechanism. The first open end 207 may be located distally from the end that the stabilizing strap 202 runs across. Additionally, the invention may comprise an elastic securing strap 204 that is also sewn to the neoprene attachment. The elastic securing strap 204 is located above the first open end 207 of the substantially cylindrical receptacle 201 and is used to secure the water bottle when it is placed in the substantially cylindrical receptacle 201. The elastic securing strap 204 may also be made of plastic or any other similar material. This application of the invention may also optionally comprise a pocket 205 sewn into the neoprene patch 200. The pocket 205 can store a cellular telephone, energy gel, a compass, or any other device the user wants. The invention may also comprise a key-storing accessory 206 that may be comprised of wire, magnets, a hook, or a loop, or both. This accessory 206 may be used to store house or car keys. The cylindrical receptacle 201, elastic securing strap 202, elastic strap 204, pocket 205, and accessory 206 may all be angled with respect to the neoprene belt loop 101.

Figure 2:
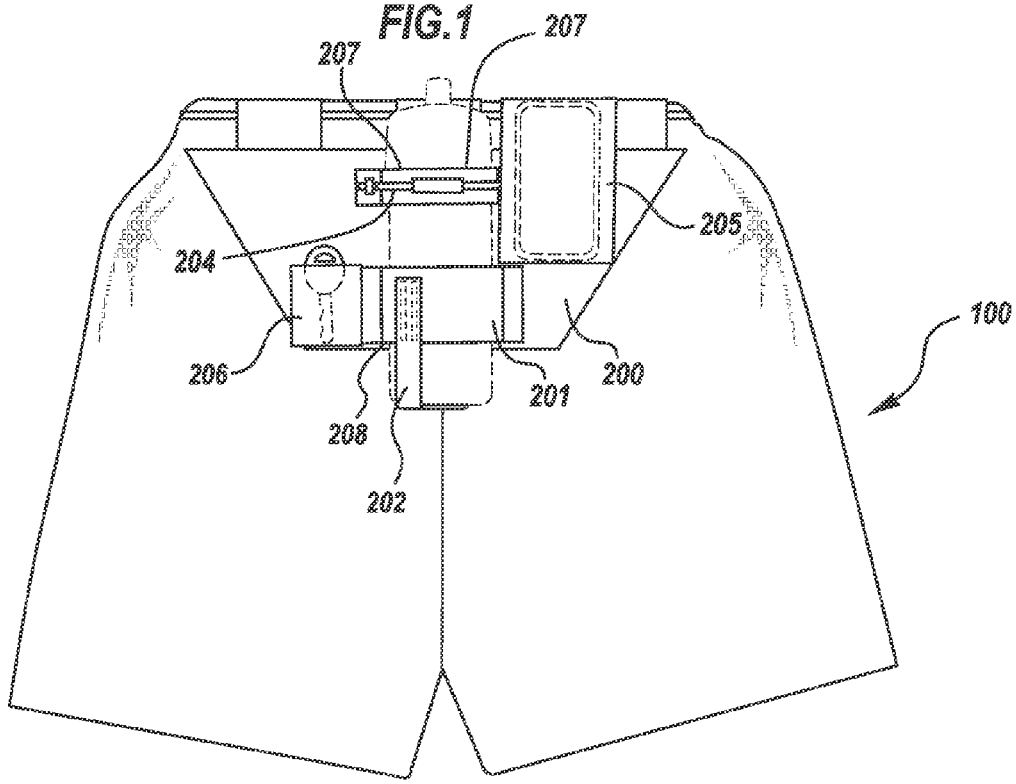
FIG. 2 illustrates a rear view of a hydration garment, according to one embodiment of the invention, including a perpendicular beverage container receptacle.

FIG. 2 shows an alternative embodiment to the invention. As shown, the cylindrical receptacle 201, stabilizing strap 202, elastic securing strap 204, pocket 205, and accessory 206 may be coupled to the neoprene patch 200 perpendicularly with respect to the neoprene belt loop 101. This embodiment still includes a first open end 207 and a second open end 208. This embodiment may be more comfortable than FIG. 1's embodiment to users with certain body shapes or running styles.

Figure 3:
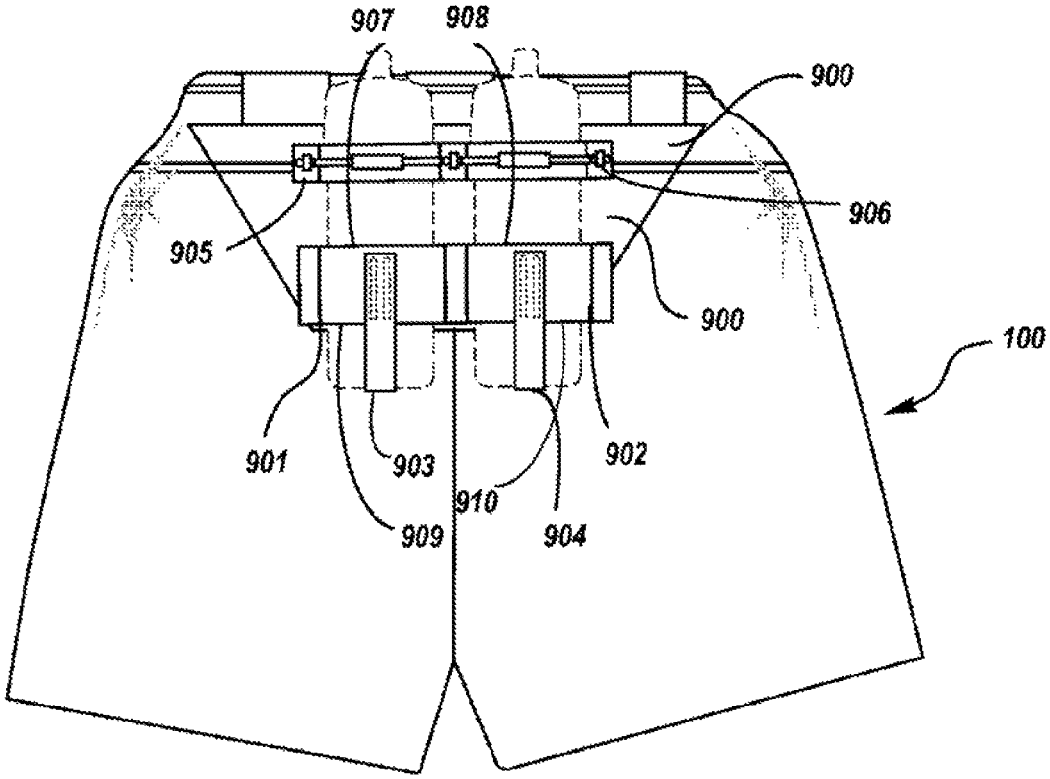
FIG. 3 illustrates a rear view of a hydration garment, according to one embodiment of the invention, configured to hold two beverage containers.

FIG. 3 shows an alternative embodiment to the invention. In FIG. 3, there is no pocket for a phone or other items, nor is there an attachment for keys. Instead, there may be at least two water bottle holders coupled to the neoprene patch 900. FIG. 3 shows a first water bottle holder has both a first open end 907 and a second open end 909. The first water bottle holder may be comprised of a first cylindrical receptacle 901, a first stabilizing strap 903, and a first elastic securing strap 905. FIG. 3 also shows a second water bottle holder that may also have both a first open end 908 and a second open end 910. The second water bottle holder may be comprised of a second cylindrical receptacle 902, a second stabilizing strap 904, and a second elastic securing strap 906. This embodiment is particularly helpful if the user plans on going on extended exercise excursions.

Figure 4:
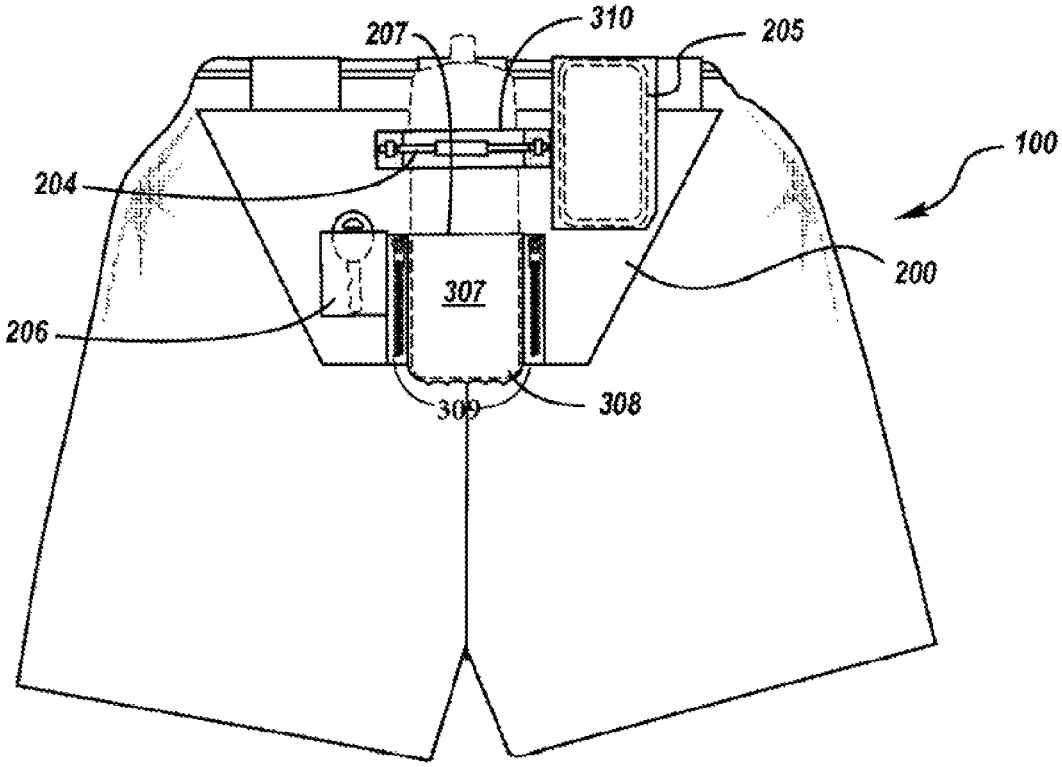
FIG. 4 illustrates a rear view of a hydration garment, according to one embodiment of the invention, including a zippered receptacle.

FIG. 4 shows an alternative embodiment to the invention. The invention still includes an elastic securing strap 204, a pocket 205, and an accessory for keys 206. It is still designed to secure a water bottle to a pair of athletic shorts. However, in this embodiment, the cylindrical receptacle 307 may be comprised of both an open end 207 and a base 308. The base 308 is made of mesh, or other similarly supportive materials. The open end 207 is located distally from the base 308. The receptacle may be attached to the neoprene pouch by zippers 309.

Figure 5:
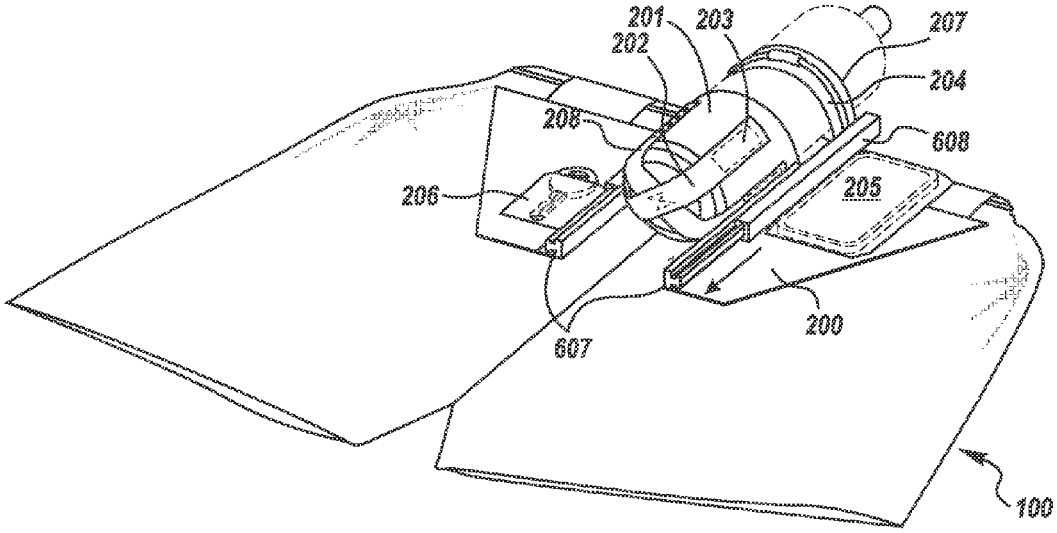
FIG. 5 illustrates a rear perspective view of a hydration garment, according to one embodiment of the invention, including a tongue and groove holster.
Figure 6:
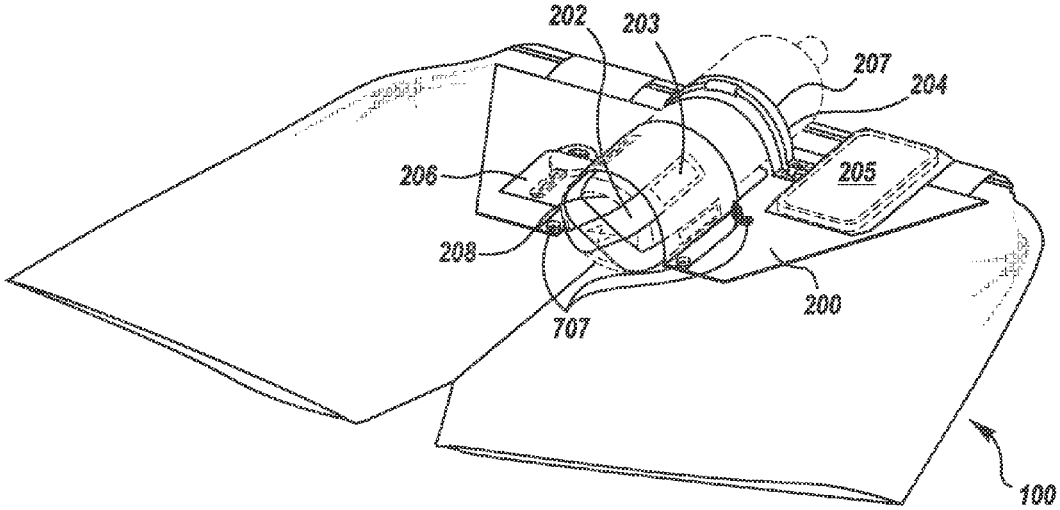
FIG. 6 illustrates a rear perspective view of a hydration garment, according to one embodiment of the invention, including a snap receptacle.

FIGS. 5 and 6 show two other alternative embodiments to the invention. Both embodiments may include an elastic securing strap 204, a pocket 205, and an accessory for keys 206. In FIG. 5's embodiment, however, the mechanism by which the cylindrical receptacle 201 may connect to the neoprene patch 200 is by a detachable tongue 608 and groove 607 holster. The one or more tongues 608 may be attached to the cylindrical receptacle 201 by a hook and loop fastener such as Velcro™ or a similar mechanism and allow for the cylindrical receptacle 201 to slide into the grooves 607, which form a track, and firmly attach to the neoprene patch 200. The tongues 608 may slide into the groove 607 of the holster either vertically, horizontally, or at an angle with respect to the user. The tongue and groove holster may work by allowing the tongue 608 to be shaped such that it will slide into the groove 607 and create a secured placement of the cylindrical receptacle 201 within the holster when the tongue 608 reaches an end of the groove 607 along the track. The tongues 608 may couple to the groove 607 holster either by a specially shaped piece at the end of the holster's track, magnets, a tying mechanism, or by any other appropriate fastener. The end of the holster's track may be placed so that it is closer to the waistband of the shorts, pants or skirt than it is to the bottom of the garment, or so it is closer to the bottom of the garment than it is to the garment's waistband. The tongues 608 and grooves 607 may be made out of plastic, wood, lightweight metals, or any other similar materials.

FIG. 6 also shows an embodiment by which the mechanism of attaching the cylindrical receptacle 201 to the neoprene patch 200 may differ. Instead of using a detachable tongue 608 and groove 607, as displayed in FIG. 5, a set of detachable snaps 707 can be used. The snaps 707 may be attached to the outside of the cylindrical receptacle and have corresponding clasps located below snaps 707 that allow the cylindrical receptacle to be buttoned, or "snapped," securely into the neoprene patch 200.

Figure 7:
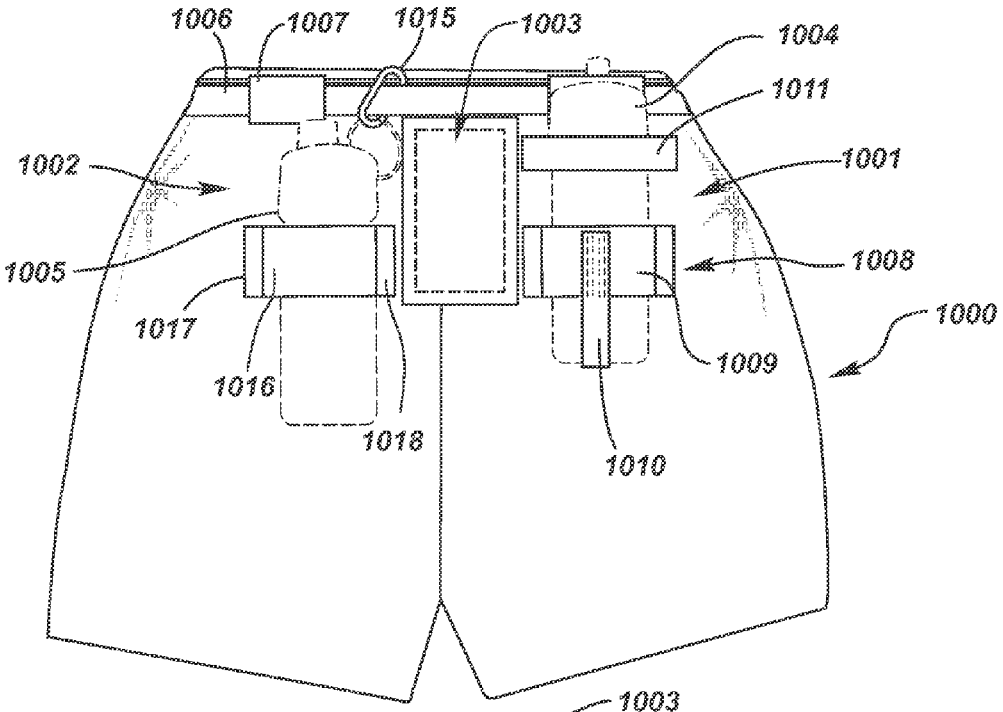
FIG. 7 illustrates a rear view of a hydration garment, according to one embodiment of the invention, including first and second beverage container holders.

FIG. 7 illustrates a lower body garment 1000, such as shorts, according to another embodiment of the invention. The shorts 1000 can include a first holder assembly 1001, a second holder assembly 1002, and one or more pockets 1003 coupled to a rear or posterior exterior surface of the shorts 1000. The shorts 1000 can also include an external waistband 1006 and loops 1007 around the external waistband 1006. As shown in FIG. 7, the shorts 1000 can be configured to hold multiple beverage containers. For example, the first holder assembly 1001 can house a first beverage container 1004, such as a water bottle, and the second holder assembly 1002 can house a second beverage container 1005, such as a water bottle or, more specifically, an empty water bottle. The shorts 1000 can be athletic shorts, compression shorts, or "2-in-1" combination compression and athletic shorts. In some embodiments where the shorts 1000 are compression shorts or 2-in-1 shorts, the external waistband 1006 may not be necessary. In addition, in alternative embodiments, the shorts 1000 can be a skirt or pants.

In some embodiments, the external waistband 1006 can be permanently coupled to the shorts 1000 in a way that allows a wearer to tighten the shorts against the wearer's waist using the external waistband 1006 and also in a way that allows components such as clips to be clipped around the external waistband 1006. The external waistband 1006 can be tightened and secured at the front of the shorts 1000 by a tie or buckle (not shown). In one embodiment, the external waistband 1006 can be internal within the waistband of the shorts 1000, with only the tie or buckle exposed to permit the wearer to tighten the shorts 1000. In addition, in some embodiments, the external waistband 1006 can be made of nylon and the loops 1007 can be made of neoprene or can be nylon straps.

As shown in FIG. 7, the first holder assembly 1001 is configured to hold the first beverage container 1004 and can include a cylindrical receptacle 1008 with a receptacle strap 1009 and a perpendicular stabilizing strap 1010, and a securing strap 1011 positioned proximal to an open end of the cylindrical receptacle 1008. The receptacle strap 1009, the stabilizing strap 1010, and the securing strap 1011 can be similar to the receptacle components described above with respect to FIGS. 1 and 2. More specifically, the receptacle strap 1009 and the stabilizing strap 1010 can secure a lower end of the first beverage container 1006 against the shorts 1000, and the securing strap 1011 can secure an upper end of the first beverage container 1004 against the shorts 1000.

According to one embodiment, the receptacle strap 1009 is coupled to the shorts 1000 via a neoprene patch. The stabilizing strap 1010 is coupled on one end to the receptacle strap 1009, by sewing, snaps, Velcro™ or other suitable connections, and on the other end to a neoprene patch coupled to the shorts 1000. Finally, the securing strap 1011 is coupled to the external waistband 1006 or one or more loops 1007. In other embodiments, the receptacle strap 1009, the stabilizing strap 1010, and the securing strap 1011 can be coupled to the shorts 1000 in a variety of ways through sewing, Velcro™, snaps, or other suitable coupling methods. For example, each of the receptacle strap 1009, the stabilizing strap 1010, and/or the securing strap 1011 can be coupled directly to the shorts 1000, thus removing the need for the large neoprene patch 200 of FIGS. 1-6. In another example, one or more smaller neoprene patches (not shown) can be coupled to the shorts 1000 and the receptacle strap 1009, the stabilizing strap 1010, and/or the securing strap 1011 can be coupled to the neoprene patches. In yet another example, the receptacle strap 1009, the stabilizing strap 1010, and/or the securing strap 1011 can be coupled to nylon straps, which are then coupled to the shorts 1000. The nylon straps may permit less stretch than the neoprene patches and, as a result, permit less bouncing of the first beverage container 1004 against the shorts 1000 when the wearer is, for example, running.

As shown in FIG. 7, the pocket 1003 can be made of neoprene and can be coupled to a neoprene patch or directly to the rear exterior surface of the shorts 1000. The pocket 1003 can store a cellular telephone, energy gel, a compass, or any other device the wearer wants. In some embodiments, the pocket 1003 may be comprised of wire, magnets, a hook, or a loop, or both in order to securely house a key. While FIG. 7 shows the pocket 1003 in a central position with respect to the rear or posterior of the shorts 1000 and the first holder assembly 1001 lateral to the pocket 1003, these elements may be switched so that the first holder assembly 1001 is in a central position while the pocket 1003 is lateral to the assembly 1001. In addition, in some embodiments, as shown in FIG. 7, the pocket 1003 and the first holder assembly 1001 can be positioned perpendicular to the external waistband 1006. In other embodiments, the pocket 1003 and/or the first holder assembly 1001 can be angled with respect to the external waistband 1006.

Figure 8:
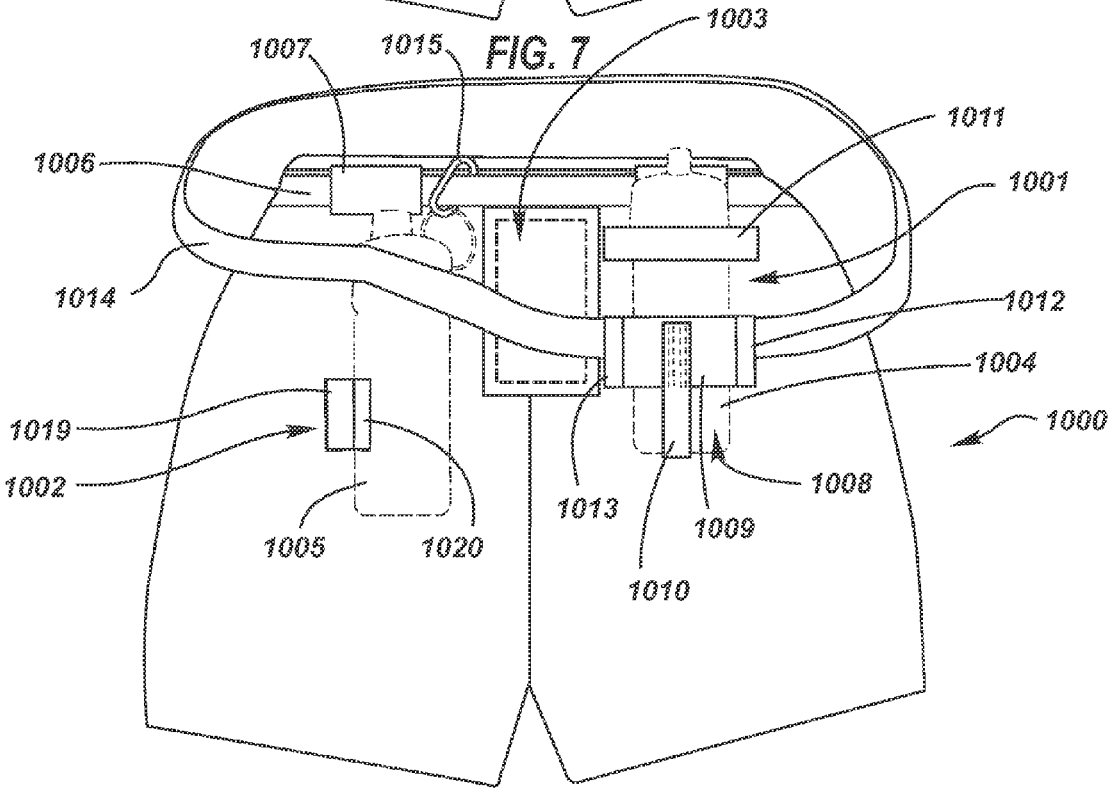
FIG. 8 illustrates a rear view of a hydration garment, according to one embodiment of the invention, including a compression strap.

FIG. 8 illustrates another embodiment of the invention, which can be incorporated into the embodiment of FIG. 7. As shown in FIG. 8, the receptacle strap 1009 is attached to the shorts 1000 at anchor points 1012 and 1013. A compression strap 1014 can be coupled to the shorts 1000 at the anchor points 1012, 1013 and configured to wrap around a wearer's thigh or torso. The compression strap 1014 can serve to press the shorts 1000 against the wearer's body at the anchor points 1012 and 1013 in order to prevent the first beverage container 1004 from bouncing against the wearer when the wearer is, for example, running, while not obstructing the wearer's leg movements.

In some embodiments, the compression strap 1014 is not coupled to the shorts 1000 directly at the anchor points 1012 and 1013. Rather, more generally, the compression strap 1014 can be coupled to the shorts 1000 at a different anchor point proximal to the cylindrical receptacle 1008 and between about one inch and about two inches below the external waistband 1006 or waistband of the shorts 1000. In addition, in some embodiments, the compression strap 1014 can be elastic and can be about two inches in width. The compression strap 1014 can also be used with the embodiments described above with respect to FIGS. 1-6. Furthermore, in some embodiments, compression shorts 1000, instead of baggier athletic shorts, may take the place of the compression strap 1014.

Referring back to FIG. 7, the second holder assembly 1002 is configured to hold the second beverage container 1005 and can include a clip 1015, such as a carabiner clip, and a securing strap 1016. The clip 1015 can be permanently coupled to the shorts 1000 or can clip around the external waistband 1006 or the loops 1007. The clip 1015 can also clip to the second beverage container 1005. The securing strap 1016 can be coupled to the rear exterior surface of the shorts 1000 and can be configured to stabilize a lower portion the second beverage container 1005 against the shorts 1000 or, more specifically, against the wearer. The securing strap 1016 can serve to prevent the second beverage container 1005 from dangling freely when clipped to the clip 1015.

In addition, the securing strap 1016 can be an elastic strap similar to the securing strap 1011 and/or the receptacle strap 1009 of the first holder assembly 1001. For example, the securing strap 1016 can be coupled to the shorts 1000 by nylon straps at anchor points 1017, 1018. In some embodiments, another compression strap (not shown) can be coupled to the shorts 1000 at the anchor points 1017, 1018 and configured to wrap around the wearer's thigh or lower torso in order to further prevent the second beverage container 1005 from bouncing when the wearer is, for example, running. In addition, the securing strap 1016 can be positioned perpendicular to the external waistband 1006 or angled with respect to the external waistband 1006.

In some embodiments, as shown in FIG. 8, the second holder assembly 1002 can include the clip 1015 and, rather than the securing strap 1016, a Velcro™ patch 1019. The patch 1019 can be coupled to the shorts 1000 below the external waistband 1006. The second beverage container 1005 can include a mating Velcro™ patch 1020 so that, when the second beverage container 1005 is clipped to the clip 1015, the second beverage container 1005 can be secured to the patch 1019 via the patch 1020 in order to secure the container 1005 against the shorts 1000.

The embodiments described above generally provide a lower body garment to hold one or more beverage containers, such as water bottles, near the backside of the wearer and secure the beverage containers against a wearer's body to prevent substantial bouncing or flopping of the beverage containers while the wearer is, for example, running. Because the beverage container holders are integrated into the lower body garment, no additional items, such as additional belts or packs, may be necessary to hold and secure the beverage containers to the wearer. In addition, because the beverage container holders include cylindrical receptacles and/or elastic straps, the garment can be used with conventional cylindrical water bottles or other cylindrical water bottles of variable circumferences.

I claim:

1. A hydration support garment comprising:

a lower body garment with a rear exterior surface;

a receptacle coupled to the rear exterior surface and configured to house a first beverage container, the receptacle comprising a stabilizing strap and a receptacle strap perpendicularly intersecting one another;

a securing strap coupled to the rear exterior surface proximal to an open end of the receptacle and configured to stabilize the first beverage container against the lower body garment when the first beverage container is housed within the receptacle;

a clip coupled to the lower body garment and configured to clip to a second beverage container; and a second strap coupled to the rear exterior surface and configured to stabilize the second beverage container against the lower body garment when the second beverage container is clipped onto the clip.

2. The hydration support garment of claim 1 further comprising a pocket coupled to the rear exterior surface proximal to the receptacle.

3. The hydration support garment of claim 1, wherein the second strap is coupled to the rear exterior surface by one of a neoprene patch and a nylon strap.

4. The hydration support garment of claim 1, wherein the second strap is coupled to the rear exterior surface at an anchor point; and further comprising a compression strap coupled to the rear exterior surface at the anchor point and configured to wrap around one of a wearer's lower torso and a wearer's thigh to stabilize the second beverage container against the wearer when the second beverage container is held by the second strap.

5. The hydration support garment of claim 1 further comprising an external waistband of the lower body garment, wherein the clip is coupled to the external waistband.

6. The hydration support garment of claim 5, wherein the external waistband is permanently coupled to the lower body garment.

7. The hydration support garment of claim 5, wherein the receptacle is positioned one of perpendicular to and angled with respect to the external waistband.

8. The hydration support garment of claim 1, wherein the lower body garment is compression shorts.

9. The hydration support garment of claim 1, wherein the lower body garment is 2-in-1 compression and athletic shorts.

10. A hydration support garment comprising:

a lower body garment with a rear exterior surface and a waistband;

a receptacle coupled to the rear exterior surface and angled with respect to the waistband, the receptacle configured to house a first beverage container and comprising a stabilizing strap and a receptacle strap perpendicularly intersecting one another;

a clip coupled to the lower body garment and configured to clip to a second beverage container; and a hook and loop patch coupled to the rear exterior surface and configured to receive a mating hook and loop patch on the second beverage container to stabilize the second beverage container against the lower body garment when the second beverage container is clipped onto the clip.

11. The hydration support garment of claim 10 further comprising an external waistband around the waistband of the lower body garment, wherein the clip is coupled to the external waistband.

12. The hydration support garment of claim 11, wherein the external waistband is permanently coupled to the lower body garment.

13. The hydration support garment of claim 10 further comprising a securing strap coupled to the rear exterior surface proximal to an open end of the receptacle and configured to stabilize the first beverage container against the lower body garment when the first beverage container is housed within the receptacle.

14. The hydration support garment of claim 10, wherein the hook and loop patch is coupled to the rear exterior surface at an anchor point; and further comprising a compression strap coupled to the rear exterior surface at the anchor point and configured to wrap around one of a wearer's lower torso and a wearer's thigh to stabilize the second beverage container against the wearer when the second beverage container is attached to the hook and loop patch.

15. The hydration support garment of claim 10, wherein the lower support garment is one of compression shorts and 2-in-1 compression and athletic shorts.

16. A hydration support garment comprising:

a lower body garment with a rear exterior surface;

a receptacle coupled to the rear exterior surface and configured to house a beverage container, the receptacle comprising a stabilizing strap and a receptacle strap perpendicularly intersecting one another;

a securing strap coupled to the rear exterior surface proximal to an open end of the receptacle and configured to stabilize the beverage container against the lower body garment when the beverage container is housed within the receptacle; and a compression strap coupled to the rear exterior surface at an anchor point proximal to the receptacle and configured to wrap around one of a wearer's lower torso and a wearer's thigh to stabilize the beverage container against the wearer when the beverage container is housed within the receptacle.

17. The hydration support garment of claim 16 and further comprising a clip coupled to the lower body garment and configured to clip to a second beverage container; and a second strap coupled to the rear exterior surface and configured to stabilize the second beverage container against the lower body garment when the second beverage container is clipped onto the clip.

18. The hydration support garment of claim 16, wherein the compression strap is elastic.

19. The hydration support garment of claim 16, wherein the receptacle strap coupled to the rear exterior surface at the anchor point.

20. The hydration support garment of claim 16, wherein the anchor point is located about one inch to about two inches below a waistband of the lower body garment.

* * * * *